United States Patent [19]

Klein et al.

[11] 4,013,402

[45] Mar. 22, 1977

[54] FIRED HEATER FOR A MULTIPHASE FEEDSTOCK

[75] Inventors: Eric Klein, Verona; Ronald Burton Goodman, Parsippany, both of N.J.

[73] Assignee: Foster Wheeler Energy Corporation, Livingston, N.J.

[22] Filed: June 11, 1975

[21] Appl. No.: 585,895

[52] U.S. Cl. ..... 432/223; 122/250 R; 122/276

[51] Int. Cl.[2] ..... F24H 1/00; F22B 11/02

[58] Field of Search ..... 432/210, 223; 122/250 R, 251, 276

[56] References Cited

UNITED STATES PATENTS

| | | | |
|---|---|---|---|
| 934,555 | 9/1909 | Lisch et al. | 122/250 R |
| 1,437,975 | 12/1922 | Hoffman et al. | 122/250 R |
| 2,348,512 | 5/1944 | Barnes | 122/250 R |
| 2,721,735 | 10/1955 | Permann | 432/223 |
| 3,379,244 | 4/1968 | Gilli | 122/250 |

*Primary Examiner*—John J. Camby
*Attorney, Agent, or Firm*—Marvin A. Naigur; John E. Wilson; Warren B. Kice

[57] ABSTRACT

A heater for heating a multiphase feedstock in which a single tube or multiple tube passes are disposed in a housing and bent into a series of contiguous loops arranged in substantially horizontally disposed superposed layers. Each layer consists of two substantially parallel straight portions respectively connecting the corresponding ends of two curved portions. A plurality of burners are provided in the housing for heating the feedstock as it passes through the entire length of the tube.

15 Claims, 6 Drawing Figures

FIRED HEATER FOR A MULTIPHASE FEEDSTOCK

BACKGROUND OF THE INVENTION

This invention relates to fired heaters and, more particularly, to fired heaters for heating a multiphase feedstock.

Fired heaters employing a plurality of tubes for passing a feedstock through a plurality of passes to heat the feedstock are well known. In these designs, the tubes are often bent back several times in a serpentine relationship to reverse the direction of the feedstock flow.

However, when dealing with a three-phase feedstock, such as a mixture of coal, oil and gas in slurry form such as found in an oil refinery, a coal treating plant, or the like, several problems are encountered by virtue of the existence of the solid coal suspended in and carried by the liquid and gas. For example, a major problem stems from the fact that the solid feedstock, which is naturally abrasive and which often is of a relatively high volume and at a relatively high pressure flowing at high velocities, impinges on the walls of the tubes and therefore causes erosion. Since the above-mentioned bends in the tubes extend for as much as 180°, this impingement, and resulting erosion, is especially severe in these bent areas.

One possible solution to this problem is to eliminate the conventional 180° bends in the tubes and provide a tube, or tubes, in a continuous curved, or helical, configuration. However, in order to provide a heat absorption comparable to that of the serpentine arrangement mentioned above and compatible with relatively large installations, the effective height and diameter of such a helical tube would be such that additional serious problems are created. For example, in an installation having a helical tube of a relatively large height, it is difficult to get enough heat to the top portion of the tube and to remove the tube for replacement, repair, or the like. Also, there is a practical limitation to the size of coil which can be accommodated and enclosed in a furnace structure.

SUMMARY OF THE INVENTION

It is therefore an object of the present invention to provide a fired heater for a multiphase feedstock in which tube erosion is minimized.

It is a further object of the present invention to provide a fired heater of the above type which enjoys the advantage set forth above yet has a relatively low vertical height and permits large capacities of feedstocks to be handled in a multitude of parallel passes.

It is a still further object of the present invention to provide a fired heater of the above type in which each parallel stream of flowing feedstock is heated equally within a single enclosure.

Toward the fulfillment of these and other objects, the fired heater of the present invention comprises a housing; at least one tube disposed in the housing and having an inlet and outlet for a feedstock, the tube being bent into a series of contiguous loops arranged in substantially horizontally disposed superposed layers, each layer consisting of two substantially parallel straight portions and two curved portions respectively connecting the corresponding ends of the straight portions; means for supporting the tube in the housing; and means associated with the housing for applying heat to the feedback passing through the tube.

BRIEF DESCRIPTION OF THE DRAWINGS

The above brief description, as well as further objects, features, and advantages, of the present invention will be more fully appreciated by reference to the following detailed description of a presently preferred but nonetheless illustrative embodiment in accordance with the present invention, when taken in connection with the accompanying drawings wherein.

DESCRIPTION OF THE PREFERRED EMBODIMENTS

Figure 1:
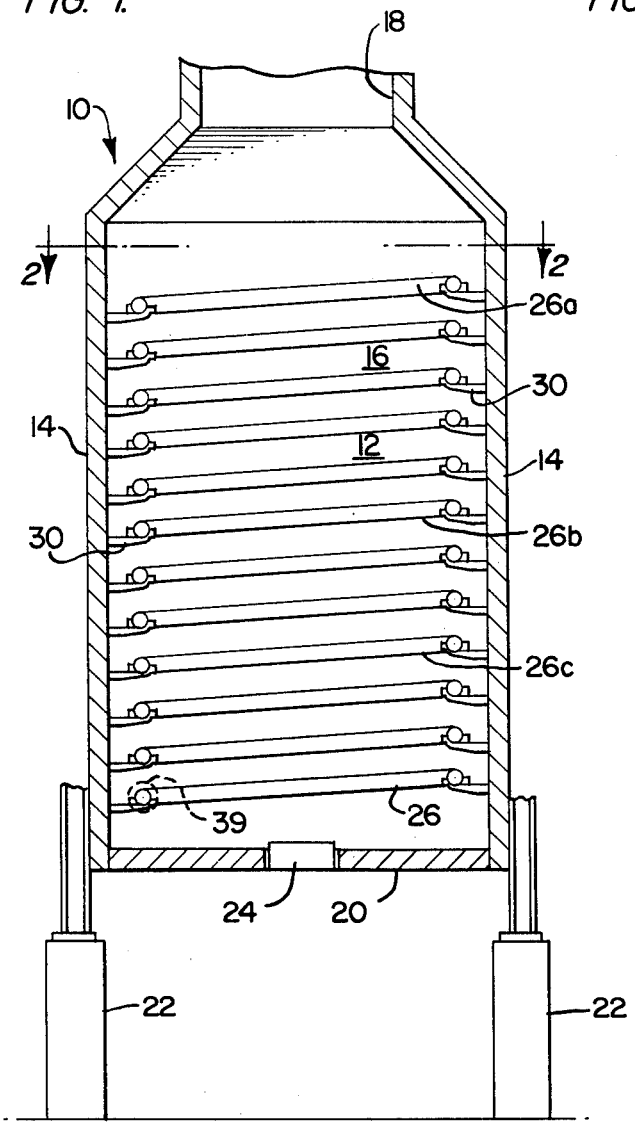
FIG. 1 is a vertical cross-sectional view of an embodiment of the fired heater of the present invention taken along the line 1—1 of FIG. 2.
Figure 2:
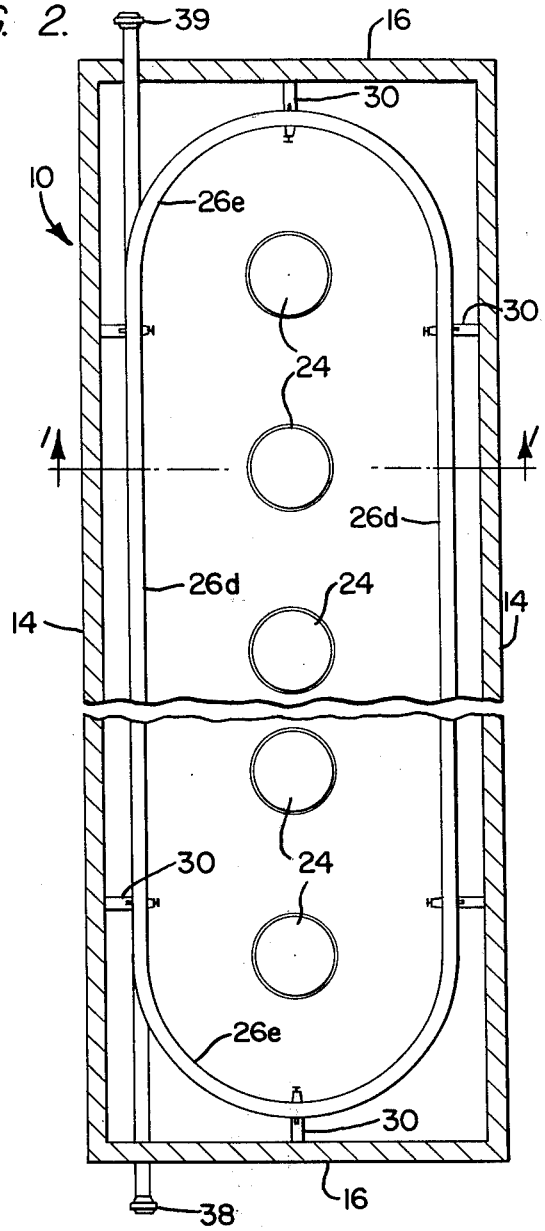
FIG. 2 is a horizontal cross-sectional view taken along the line 2—2 of FIG. 1.

An exemplary embodiment of the fired heater of the present invention is shown in general by the reference numeral 10 in FIGS. 1 and 2 of the drawings, and includes a chamber 12 bounded by a first pair of opposed walls 14 and a second pair of opposed walls 16 connected to the walls 14. The upper portion of the walls 14 slope inwardly to define a gas outlet section 18 which may be connected to a convection section, or to a stack, or another stage of the system. A floor 20 is connected to the walls 14 and 16 and the enclosure thus formed is supported by a plurality of supports 22 in a conventional manner. The walls 14, 16, and the floor 20 are of a refractory material of any conventional type. A plurality of burners 24 extend in a spaced relationship through the floor 20 and operate in a conventional manner to apply heat to the chamber 12.

A single tube, shown in general by the reference numeral 26, is bent into a series of contiguous loops arranged in substantially horizontally disposed superposed layers extending for substantially the entire length of the chamber 12, with three random layers being referred to in FIG. 1 by the reference numerals 26*a*, 26*b*, and 26*c*. As shown in FIG. 2, each layer of the tube 26 consists of two parallel straight portions 26*d* connected at their respective ends to two curved portions 26*e* of a substantially semi-circular shape, to form a complete loop. The straight portions 26*d* are substantially horizontal and extend adjacent, and substantially parallel to, the walls 14 while the curved portions 26*e* extend at a slight angle to a horizontal plane and adjacent the walls 16.

It is noted from FIGS. 1 and 2 that the length of each tube portion 26*d* is greater than the height of the tube 26. As an example of the particular dimensions of these portions of the tube 26, the effective length of the curved portions 26*e* can be 12 feet, the length of the straight portions 26*d* can be 40 feet, and the effective height of the tube coil can be 20 feet.

Figure 3:
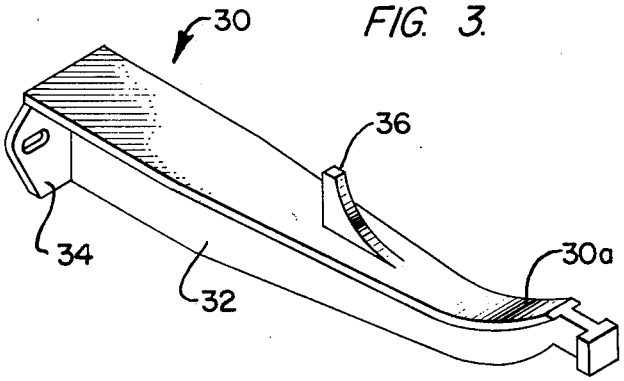
FIG. 3 is an enlarged, perspective view of a component of the fired heater of FIGS. 1 and 2.

Each layer of the tube 26 is supported at several points within the chamber 12 by a plurality of support members 30, one of which is shown in detail in FIG. 3. In particular, each support member 30 is in the form of an elongated bracket 32 attached at one end to the inner surface of the walls 14 or 16 by means of a mounting flange 34 extending from the bracket and bolted or otherwise secured to the latter surface, in a conventional manner. The free end portion of the bracket 32 is curved, as shown at 30*a*, and together with a complementary curved portion formed by a flange 36 extending from the upper surface of the bracket, forms a curved support surface for receiving a corresponding portion of the tube 26. As shown in FIGS. 1 and 2, a plurality of the support members 30 support each horizontal layer of the tube 26 at a plurality of locations along the walls 14 and at a single location at each wall 16, while accommodating thermal expansion and internal pressure deflection of the tube.

The upper end portion of the tube 26 extends through the front wall 16 to form an inlet 38 for a feedstock, such as a three phase mixture of solid coal, oil, and gas. In a similar manner, the lower end portion of the tube 26 extends through the rear wall 16 to provide an outlet 39 for discharging the feedstock to another stage of the system.

In operation, the feedstock is introduced into the inlet 38 of the tube 26 and passes through the entire length of the tube where its temperature is gradually raised by the heat from the burners 24. During the passage, the feedstock will undergo relatively gradual changes in direction as it passes from a straight section 26*d* of a particular layer of the tube 26 through the corresponding curved section 26*e* to the adjacent superposed layer of the tube, before passing through the remaining tube layers and exiting from the outlet 39. This minimizes impingement of the solid portions of the feedstock upon the inner wall of the tube 26 and thus reduces erosion. Also, as a result of the relatively long sections 26*d*, the height of the tube 26 is considerably reduced when compared to comparable helical coil designs.

Figure 4:
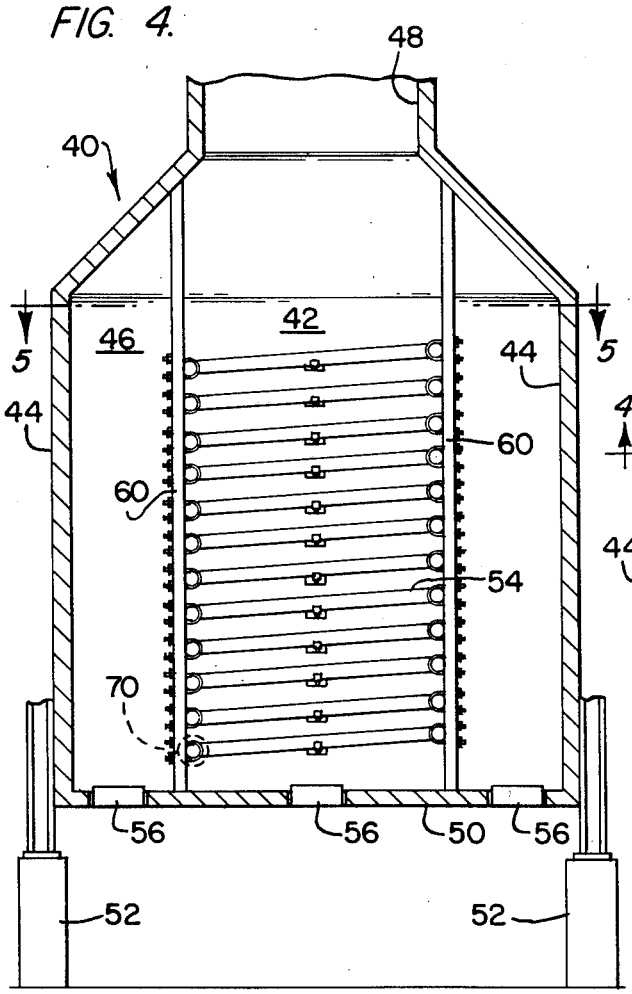
FIGS. 4–5 are similar to FIGS. 1 and 2, respectively, but depicting an alternate embodiment of the fired heater of the present invention.
Figure 5:
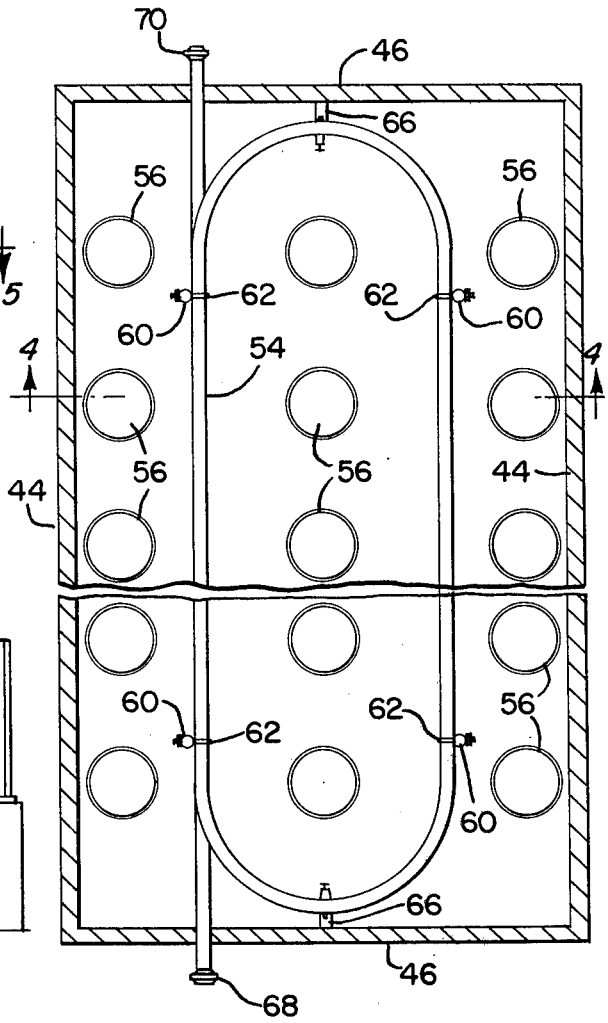
Figure 6:
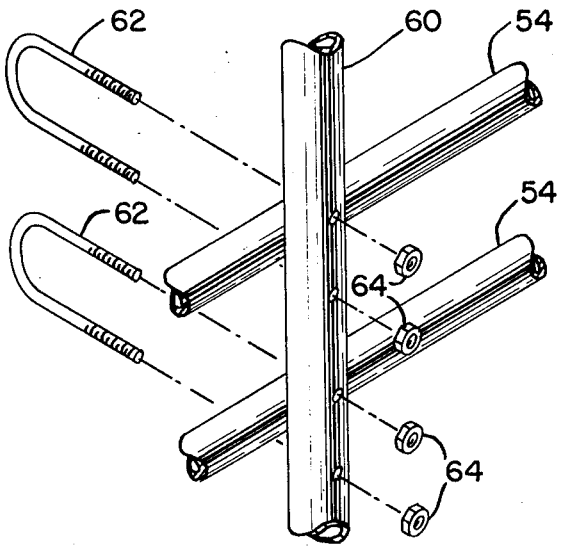
FIG. 6 is an exploded, enlarged, partial, perspective view of a subassembly of the fired heater of FIGS. 4 and 5.

An alternate embodiment of the fired heater of the present invention is shown in general by the reference numeral 40 in FIGS. 4–6 of the drawings and includes a chamber 42 bounded by a first pair of opposed walls 44 and a second pair of opposed walls 46 connected to the walls 44. The upper portion of the walls 44 slope inwardly to define a gas outlet section 48 which may be connected to a convection section, or to a stack, of another stage of the system. A floor 50 is connected to the walls 44 and 46 and the enclosure thus formed is supported by a plurality of supports 52 in a conventional manner. The walls 44, 46, and the floor 50 are of a refractory material of any conventional type.

A single tube, shown in general by the reference numeral 54, is disposed in the chamber 42, and, since it is identical to the tube 26 of the previous embodiment, it will not be described in any further detail.

According to a main feature of this embodiment, three spaced rows of spaced burners 56 extend through the floor 50 for applying heat to the chamber 42. Each burner 56 in the central row is directed upwardly between the corresponding straight portions of each layer of the tube 54, while each burner in the outer rows is directed between the straight portions of the tube and the corresponding walls 44, respectively.

Each straight section of each layer of the tube 54 is supported at several spaced points in a manner better shown in FIG. 6. In particular, two rows of spaced pipes 60 extend from the floor 50 to the upper portion of the walls 44 with each row of pipes extending parallel to a wall 44. A plurality of openings are formed in each pipe 60 to receive a plurality of U-bolts 62 through which portions of the tube 54 extend. The U-bolts 62 are secured to the pipes 60 by a plurality of nuts 64, it being understood that the resulting attachment between the U-bolts 62 and the corresponding portions of the tube 54 are relatively loose to accommodate thermal expansion and internal pressure deflection of the tube. The curved sections of each layer of the tube 54 are supported by support members 66 which are identical to the support members 30 of the previous embodiment.

The upper end portion of the tube 54 extends through the front wall 46 to form an inlet 68 for a feedstock, such as a three phase mixture of solid coal, oil, and gas. In a similar manner, the lower end portion of the tube 56 extends through the rear wall 46 to provide an outlet 70 for discharging the feedstock to another stage of the system.

The operation of the embodiment of FIGS. 4–6 is similar to that of FIGS. 1–3 with the exception that the three spaced rows of burners 56 permit a higher average rate of heat transfer to the feedstock flowing through the various layers of the tube 54, while at the same time maintaining a maximum "point" heat transfer, and therefore, not subjecting the fluid contained within the tubes to a higher temperature where the fluid contacts the tube.

It is understood that several variations may be made in the foregoing without departing from the scope of the invention. For example, although only a single tube has been described in connection with each embodiment of the present invention, it is understood that a multiple of tubes can be utilized without departing from the scope of the invention. Of course, still other variations of the specific construction and arrangement of the heater disclosed above can be made by those skilled in the art without departing from the invention as defined in the appended claims.

What is claimed is:

1. A heater for heating a feedstock at least a portion of which is in solid form, comprising a housing; at least one tube disposed in said housing and having an inlet and an outlet for said feedstock, said tube being bent in a manner to form a plurality of contiguous superposed layers, each layer consisting of two substantially parallel straight portions and two curved portions respectively connecting the corresponding ends of said straight portions, each curved portion extending at an acute angle relative to a horizontal plane; means for supporting said tube in said housing; and means associated with said housing for applying heat to said feedstock passing through said tube.

2. The heater of claim 1 wherein said curved portions of said tube are semi-circular in shape.

3. The heater of claim 1 wherein each of said straight portions of said tube extends substantially horizontally.

4. The heater of claim 1 wherein said supporting means comprises a plurality of elongated bracket members attached to the inner walls of said housing and defining a curved surface for receiving portions of said tube.

5. The heater of claim 1 wherein said supporting means comprises a plurality of vertically extending pipes supported in said housing, and a plurality of U-bolts secured to said pipes and adapted to receive portions of said tube.

6. The heater of claim 1 wherein said heat applying means comprises a row of burners extending through the floor of said housing and directed between the straight portions of each of said layers of said tube.

7. The heater of claim 6 wherein said heat applying means further comprises two additional rows of burners each extending parallel to said first row of burners and directed between the respective straight portions of said tube and the corresponding walls of said housing.

8. A heater for heating a feedstock at least a portion of which is in solid form, comprising a housing; at least one tube disposed in said housing and having an inlet and an outlet for said feedstock, said tube being bent in a manner to form series of contiguous superposed layers, each layer consisting of two substantially parallel straight portions of two curved portions respectively connecting the corresponding ends of said straight portions, each layer occupying a substantial portion of the horizontal cross-sectional area of said housing, means for supporting said tube in said housing; and means associated with said housing for applying heat to said feedstock passing through said tube.

9. The heater of claim 8, wherein said curved portions of said tube are semi-circular in shape.

10. The heater of claim 8, wherein each of said straight portions of said tube extends substantially horizontally and each of said curved portions extends at an acute angle to a horizontal plane.

11. The heater of claim 8, wherein said supporting means comprises a plurality of elongated bracket members attached to the inner walls of said housing and defining a curved surface for receiving portions of said tube.

12. The heater of claim 8, wherein said supporting means comprises a plurality of vertically extending pipes supported in said housing, and a plurality of U-bolts secured to said pipes and adapted to receive portions of said tube.

13. The heater of claim 8, wherein said heat applying means comprises a row of burners extending through the floor of said housing and directed between the straight portions of each of said layers of said tube.

14. The heater of claim 13, wherein said heat applying means further comprises two additional rows of burners each extending parallel to said first row of burners and directed between the respective straight portions of said tube and the corresponding walls of said housing.

15. The heater of claim 8, wherein each curved portion of said tube extends for substantially the entire width of said housing.

* * * * *